United States Patent [19]

Howard

[11] 4,275,373

[45] Jun. 23, 1981

[54] COMBINATION EXPULSION FUSE

[75] Inventor: John F. Howard, Peterborough, Canada

[73] Assignee: Canadian General Electric Co., Ltd., Toronto, Canada

[21] Appl. No.: 108,185

[22] Filed: Dec. 26, 1979

[30] Foreign Application Priority Data

Aug. 24, 1979 [CA] Canada ..... 334516

[51] Int. Cl.[3] ..... H01H 71/20

[52] U.S. Cl. ..... 337/144; 337/161; 337/219

[58] Field of Search ..... 337/144, 161, 162, 168, 337/177, 178, 181, 219

[56] References Cited

U.S. PATENT DOCUMENTS

| | | | |
|---|---|---|---|
| 2,917,605 | 12/1959 | Fahnoe | 337/162 X |
| 3,783,342 | 1/1974 | Thiel et al. | 337/144 X |
| 4,083,028 | 4/1978 | Haubein et al. | 337/144 |
| 4,114,128 | 9/1978 | Cameron | 337/162 |
| 4,121,186 | 10/1978 | Santilli | 337/161 |
| 4,184,138 | 1/1980 | Beard et al. | 337/144 |

*Primary Examiner*—George Harris

*Attorney, Agent, or Firm*—William Freedman

[57] ABSTRACT

A combination fuse has a current limiting section and a low current expulsion section with the expulsion section within the high current section. This arrangement makes it possible to increase the length of the expulsion tube as compared to the prior art and provide greater arc cooling without increasing the overall length of the fuse. In addition the fuse arrangement places one fuse terminal between the ends of the fuse rather than at one end as in the prior art, thereby reducing the strain on the mounting means and the tendency to vibrate. The expulsion section includes an expulsion tube with a standard fuse link inside. The expulsion tube is mounted within the casing of the current limiting section to an end closure at one end of the casing. The expulsion tube projects through an end closure at the other end of the casing. A connector terminal is mounted to the casing adjacent the end from which the expulsion tube projects. The current limiting fuse wire extends from the terminal, spirals around the expulsion tube to the other end of the casing and connects there with the fuse link. The connector terminal also serves as a mounting means.

10 Claims, 4 Drawing Figures

COMBINATION EXPULSION FUSE

BACKGROUND

This invention relates to a combination expulsion fuse, that is it relates to a fuse having a current limiting section and an expulsion section.

Current limiting fuses and low current expulsion fuses are well known in the art. A current limiting fuse is used where there are high fault currents in order to limit the high current when a fault occurs, and to restrict the current to a lower magnitude that can be handled by another fuse or trip arrangement. An expulsion fuse is for lower fault currents and it normally has an open ended expulsion tube which contains a fuse link with a flexible cable secured to it. The cable extends out the open end of the tube and is fastened to a spring arrangement which places a force on the cable keeping it in tension. The expulsion tube is frequently coated on its inner surface with a composition which releases moisture when an arc is formed within the tube thereby cooling the arc, absorbing some arc energy which helps to extinguish the arc. Melting of the fuse link under fault current causes an arc within the tube which generates gases. The gases and the spring force on the cable cause the fuse link cable to be expelled or ejected, and the expelled cable produces a visual air gap indicating a blown fuse.

In recent years the use of capacitor banks for phase angle correction in electrical systems has become commonplace. The banks are made up of a number of capacitors in a series/parallel arrangement to provide the required correction at the necessary voltages and it is very desirable to have a fuse in series with each capacitor. If a capacitor fails all those in parallel with it will tend to discharge through the failed capacitor and this could involve a considerable amount of electrical energy. If the failed capacitor is not removed from the circuit quickly the large amounts of energy could rupture the capacitor and could damage the bank. It was found that a desirable protective means is to use, in series with each capacitor, a combination fuse which has a current limiting section and an expulsion section in series. If a capacitor fails the large fault current will be limited by the current limiting portion and this limited current will cause the fuse link in the expulsion section to blow with a resulting indication of a blown fuse and a failed capacitor.

The combination fuse, that is the combination current limiting fuse and expulsion fuse, may be used for other purposes than the protection of capacitors but they are particularly suitable for use with capacitors and will be described in that respect.

Known designs of combination fuses have the current limiting section and the expulsion section in electrical series relationship and in mechanical series relationship. The current limiting section has a long cylindrical casing with a closure cap of conducting metal at each end. The caps may serve as contact or terminal members. Within the casing is a centrally located rod of insulating material. This rod may support the fuse wires or fuse elements or it may be surrounded by a spiral fuse element for which it does not provide direct support. The rod may have spiral grooves on the surface to hold fuse wires or fuse elements. The fuse wires, of silver or other suitable metal, extend from one closure cap to the other. The casing is filled with pulverulent arc quenching material such as silicon dioxide sand. Under fault conditions the fuse wires melt and/or vapourize and the fused metal condenses in the sand. Any arcs formed are confined and cooled by the sand. The restriction of the arc produces a high arc voltage which tends to oppose the system voltage and limits the current.

Normally one of the closure caps is mounted to a bus bar in the capacitor bank and the fuse is supported from this mounting. Attached to the closure cap at the other end is the expulsion tube of the low current expulsion section so that the current limiting and expulsion sections are in end to end abutting relationship (i.e., a mechanical series arrangement). One end of a fuse link is attached to the closure cap and a flexible fuse link cable extends from the other end of the link down the expulsion tube and out the open end of the tube to connect with a terminal of a capacitor. A spring arm or other spring means places tension on the cable. As was previously explained, melting and/or vapourization of the fuse link in the expulsion tube creates an arc which forms gases and these gases tend to expel the cable. This is assisted by the spring tension on the cable.

It is desirable to have a relatively long expulsion tube as the tube tends to cool the arc and extinguish it. The longer the tube, the greater the cooling action. However, in the prior art the length of the expulsion tube is necessarily limited because the combination fuse is supported or mounted at one end and there is a practical limit to the length the fuse can extend from this support. The fuses are normally mounted at an angle, inclined downwardly from the supporting end, to reduce the amount of moisture and dirt which might otherwise enter the expulsion tube. A long fuse increases the strain on the mounting and increases the tendency for vibration.

The present invention provides for a structural arrangement permitting a longer expulsion section with a shorter overall length to the combination fuse. In addition, the arrangement provides for a mounting terminal adjacent the end of the current limiting section from which the expulsion tube extends thereby reducing the distance the fuse extends from the mounting point to reduce the strain on the mounting and reducing the tendency to vibrate.

SUMMARY

An appropriate structure for a combination fuse according to the invention comprises a current limiting portion with a cylindrical casing and a closure cap at each end of the casing. The caps may be of insulating material or if desired of non-insulating material. The expulsion tube projects through an opening in one of the caps and extends longitudinally within the casing substantially to the far end where it is secured to the closure cap. A metal terminal is mounted to the casing adjacent the end cap with the projecting expulsion tube, and a fuse wire extends from this terminal through the casing to spiral around the portion of the expulsion tube within the casing to the far end thereof. The fuse wire is preferably self-supporting and spaced from the expulsion tube. The space between the casing and the expulsion tube is filled with an arc-extinguishing material, such as silicon dioxide sand, which provides some support for the fuse wire. The fuse wire, at the end of the expulsion tube within the casing, is connected to one end of a standard fuse link within the tube. The fuse link includes a fusible portion and a flexible fuse link cable. The connection is made to the fusible portion and the flexible cable extends within the tube to project from the open end. Thus, the expulsion tube extends within the casing of the current limiting portion substantially the entire length and projects from one end thereof. This provides a longer length of expulsion tube with a smaller overall length than when the two sections are in abutting end to end relationship. In addition, the terminal on the casing, which serves as a mounting terminal, is not at the end of the combination fuse.

Thus, according to one form of the present invention there is provided a fusible device comprising a cylindrical casing having a first end and a second end, a first end closure closing said first end of said casing, an expulsion tube within said casing extending substantially coaxially therewith mounted at one end to said first end closure and projecting beyond said second end of said casing and terminating with an open end, a second end closure at said second end of said casing in sealing relationship with said casing and said expulsion tube, a fusible link within said expulsion tube having a fusible portion and a flexible cable extending to and projecting from said open end, a connector terminal at said second end of said casing, and a fuse element within said casing, extending helically around said expulsion tube, connected at one end to said connector terminal and at the other end adjacent said first end closure to said fusible link.

BRIEF DESCRIPTION OF DRAWINGS

The invention and a prior art arrangement will be described with reference to the drawings, in which.

DESCRIPTION OF PRIOR ART

Figure 1:
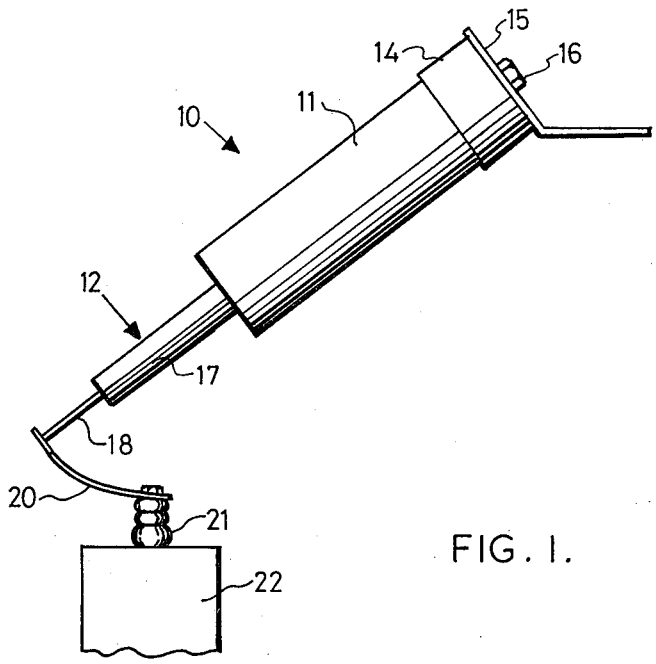
FIG. 1 is a side view showing a typical prior art combination fuse in a known mounting arrangement with a capacitor.

Referring now to FIG. 1, there is shown a prior art combination fuse 10 having a current limiting section 11 and an expulsion section 12. A metal end closure 14 forms one electrical terminal and this is also the mounting means. The end closure 14 is fastened to a bracket 15 by a nut 16. The bracket 15 is connected to a bus bar (not shown). The expulsion tube 17 of the expulsion section 12 abuts the end of the current limiting section 11, as shown. A flexible fuse link cable 18, which is fastened to a fuse link within expulsion tube 17, extends out the open end of expulsion tube 17 and is connected to one end of a spring arm 20. The other end of spring arm 20 is connected to a capacitor terminal 21 of capacitor 22. Spring arm 20 is flexed, that is it tends to assume a straight position when released. It serves to place tension in the cable 18 as well as provide an electrical connection between the cable 18 and the capacitor 22. It will be noted that the open end of expulsion tube 17 is some distance from the bracket 15 which is the mount supporting the combination fuse. If the expulsion tube 17 is made longer to increase the cooling of the arc, then the open end of tube 17 is even farther from the supporting point. This would put a greater strain on the mount and make the assembly more susceptible to mechanical damage and vibration.

DETAILED DESCRIPTION OF PREFERRED EMBODIMENT

Figure 2:
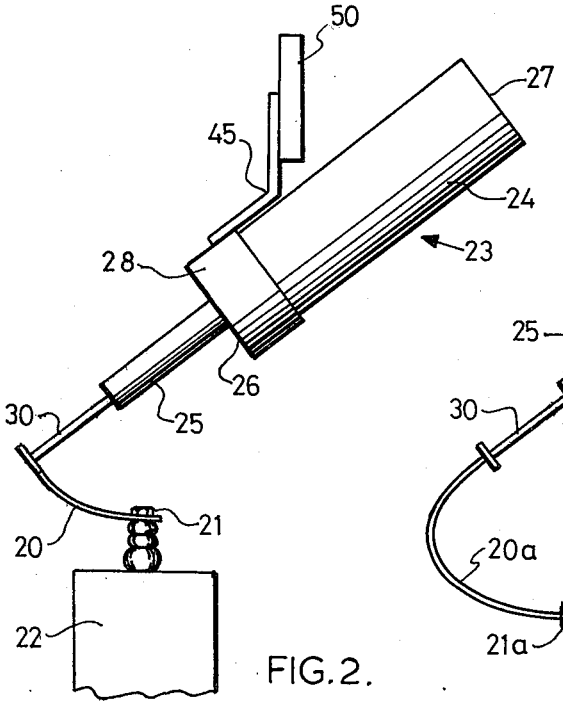
FIGS. 2 and 2A show a combination fuse according to the invention in two mounting arrangements with a capacitor.
Figure 2A:
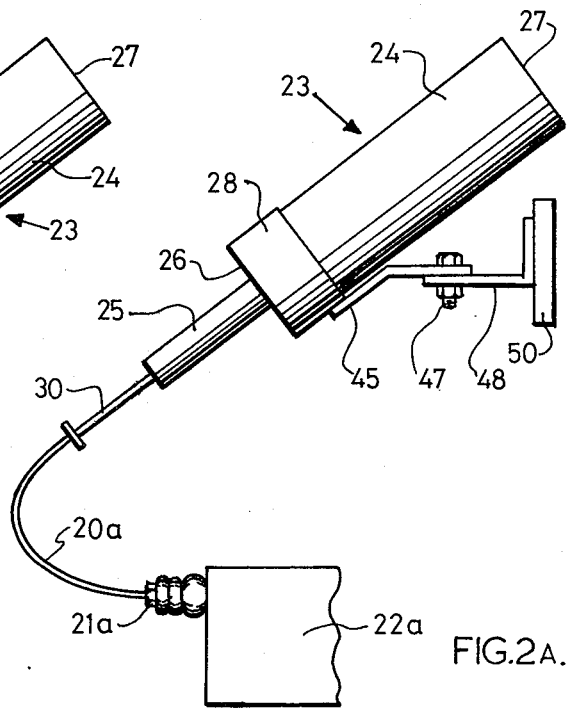

FIGS. 2 and 2A show a combination fuse 23 according to the invention but with each figure showing a different mounting arrangement. The fuse 23 has a casing 24 which houses the current limiting section of the fuse, and an expulsion tube 25 projects from a tube closure or end 26 of casing 24. The expulsion tube 25 is not abutted against end 26 but rather extends through end 26 inside casing 24 as will be explained hereinafter. The other end 27 of casing 24 has a closure for the casing, but this end does not have an electrical terminal or a mount. Because the tube 25 extends within casing 24 it can be considerably longer without increasing the overall length of the fuse. The overall length can, in fact be less than that of the prior art fuses while having a longer expulsion tube. A metallic connector terminal 28 is provided adjacent end 26 and this terminal 28 serves as an electrical connection and a mechanical mount. Thus the fuse 23 is mounted by terminal 28 so that the fuse extends both ways from the mounting region. This provides a stronger mechanical mount than the prior art end mount and reduces the tendency to vibrate.

In FIG. 2 a flexible cable 30 extends from the open end of expulsion tube 25 and fastens to one end of spring arm 20. The other end of spring arm 20 is connected to terminal 21 of capacitor 22. In FIG. 2A the flexible cable 30 is connected to one end of a spring arm 20*a*. The other end of spring arm 20*a* is connected to terminal 21*a* of capacitor 22*a*. The spring arms 20 and 20*a* of FIGS. 2 and 2A both serve the same function as the spring arm 20 of FIG. 1.

Figure 3:
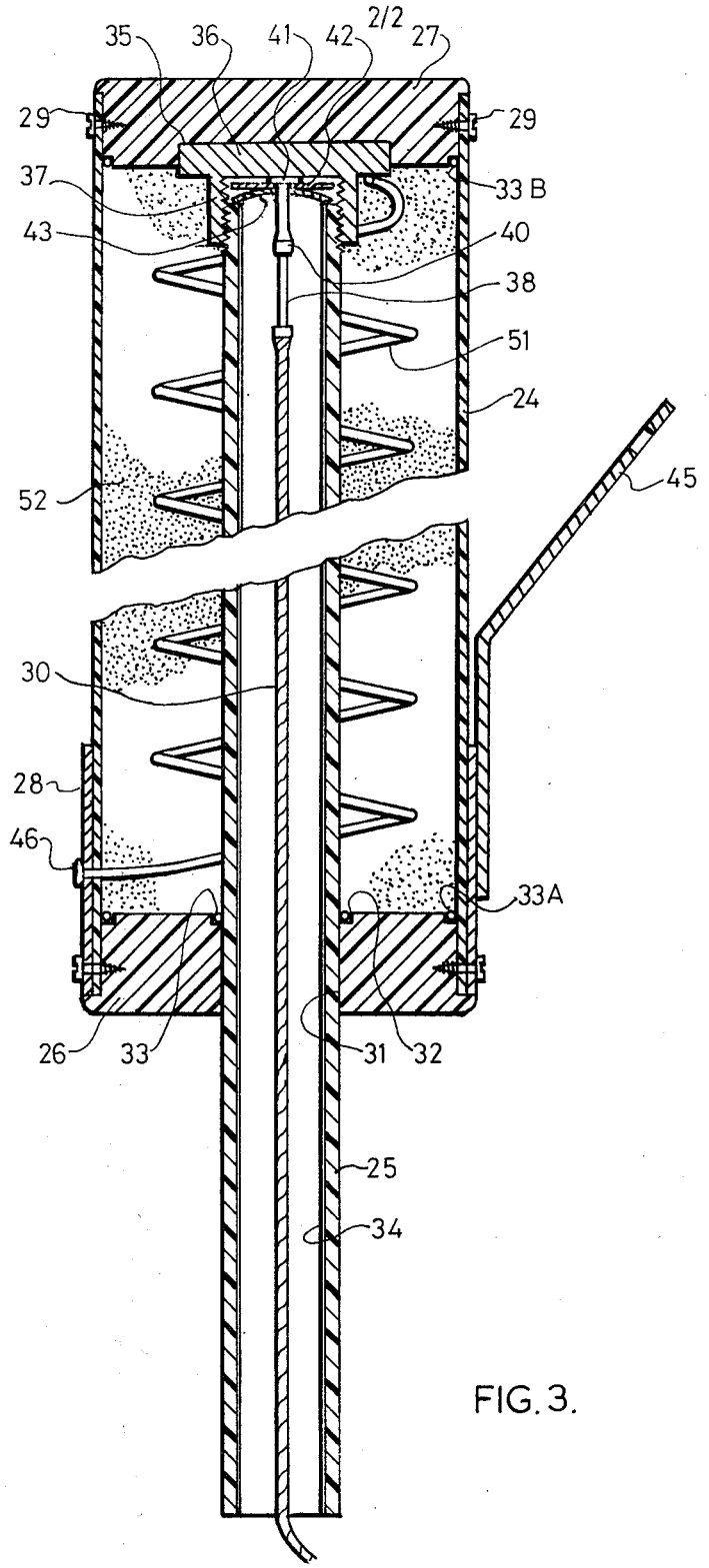
FIG. 3 is a sectional view of a combination fuse according to the invention.

Referring now to FIG. 3, a cylindrical casing 24 of insulating material, for example made of fibreglass cloth and epoxy resin, has an end closure or end cap 27 preferably of plastic material such as, for example, a phenolic resinous material. As there is no external connection to the end closure 27, it could, of course, be of metal but an insulating material is preferred. The end closure 27 is secured within the end of casing 24 using an adhesive or using a combination of an adhesive and screws 29 or other mechanical fastening devices. An end closure 26 having an annular body of an insulating material closes the other end of casing 24. The body of end closure 26 may, for example, be a plastic insulating material such as a phenolic resinous material. End closure 26 may be secured within casing 24 by using an adhesive, or screws 29 or a combination of adhesive and screws 29. End closure 26 has a central opening 31 to receive expulsion tube 25, which is of electrical insulating material. An annular groove 32 at opening 31 holds an O-ring seal 33 to provide a seal between expulsion tube 25 and the body of the end closure 26. Similarly O-ring seals 33A and 33B may be provided as shown to form seals between the bodies of end closure 26 and 27 and casing 24. The expulsion tube 25 may have a coating 34 as shown on the inner surface thereof which releases a cooling liquid such as water when heated by an arc.

End closure 27 has mounted on its inner side an end member 35 of a conducting metal such as brass. Member 35 has a base 36 and a cylindrical portion 37 extending from the base. The cylindrical portion 37 has an internal thread and the end of expulsion tube 25 has an external thread for engagement therewith. A standard fuse link which includes a fusible portion 38 and a flexible cable 30 is located within expulsion tube 25. A coupling unit 40 couples or connects one end of fusible portion 38 to a flat end 41. A flat washer 42 bears against the flat end 41 holding it against the base 36 of end member 35. A curved washer or spring washer 43 bears against washer 42 and against the end of expulsion tube 25. Thus when expulsion tube 25 is screwed into the cylindrical portion 37 of end member 35 it bears against washer 43 to retain the flat end 41 in position against base 36 of end member 35. The other end of fusible portion 38 is connected to cable 30 which extends externally of expulsion tube 25 as was described in connection with FIGS. 2 and 2A. The fusible portion 38 may be surrounded by a cylinder within the expulsion tube. This cylinder usually has arc quenching properties and is useful in fuses where the fusible element is replaced and the tube 25 retained for re-use.

A connector terminal 28 is fastened to casing 24 adjacent end closure 26. The terminal 28 may comprise a cylindrical metal ring which engages the outer surface of casing 24. The terminal 28 has mounted on it, for example by welding, a bracket 45 to support the fuse and provide an electrical connection thereto. The terminal 28 may be connected by a bolt and nut 47 to a bracket part 48 which is in turn connected to a bus bar 50, all as shown in FIG. 2A.

Referring again to FIG. 3, a fuse wire or fuse element 51 is connected to terminal 28 at point 46 by brazing or similar means and fuse wire 51 extends through casing 24 to spiral around the expulsion tube 25 to the other end thereof where it is connected to end member 35. The fuse element is thus in a helical configuration about tube 25. Preferably the fuse wire 51 is spaced from the expulsion tube 25 as shown and is self supporting. That is the fuse wire supports itself during assembly until the interior of casing 24 is filled with granular material such as silicon dioxide sand 52. Once the casing is filled with sand, the sand will provide support for the main fuse wire 51. In one embodiment of a fuse intended for operation at 18 kV and greater than about 6000 A short circuit current (60 Hz) the fuse wire 51 consisted of 6 to 8 ft. of 17 AWG copper wire. The fuse wire used would, of course, depend on the desired characteristics and the selection would be within the capability of a person skilled in the art.

The structure is conveniently assembled by joining together end closure 27 and end member 35, placing the fusible link comprising the fusible portion 38, cable 30, coupling 40 and washers 42 and 43 in position in the expulsion tube 25, and screwing the expulsion tube 25 into the cylindrical portion 37 of end member 35 with the fusible link in position. The fuse wire is placed around the expulsion tube and brazed or otherwise fastened to base 36 of end member 35. The terminal 28 is mounted on casing 24 and then the previously assembled parts are inserted into position within the casing. End closure 27 is fastened to casing 24, preferably using a heat resistant adhesive. The free end of the fuse wire 51 is brazed or fastened to terminal 28. Casing 24 is now filled with a suitable sand material. Then the end closure 26 comprising O-ring seal 33 is placed over expulsion tube 25 and slid into position within casing 24 and fastened to the casing, preferably using a heat resistant adhesive.

As previously mentioned, combination fuses of this type are particularly suitable for use with capacitors in capacitor banks. In such a capacitor bank the $I^2.t$ value resulting from a failed capacitor might initially be of the order of 10 $kA^2$-seconds or more and if the capacitor is not disconnected quickly it will heat rapidly and burst. When the large fault current flows through main fuse wire 51 the coiled wire will start to arc along its length. The inductance of the coil has a tendency to reduce to some extent the instantaneous transients that are initiated with the current surge and this tends to have some effect on reducing peak current. The arcing along the fuse wire 51 continues to build up, interacting with the surrounding sand, increasing the resistance of the path and limiting the current. The fusible portion 38 of the fusible link starts to melt and/or vapourize creating an arc within expulsion tube 25. The arc interacts with the walls of expulsion tube 25, and with coating 34 if one is provided, creating gases. The walls cool the arc and the cooling effect continues along the expulsion tube. The gases blow the cable 30 out of the expulsion tube assisted by the spring force on cable 30 and the circuit is interrupted. The absence of the cable 30 is an indication of a blown fuse.

The combination fuse of the invention has been described with several aspects and variations. It is believed other aspects and variations will be apparent to those skilled in the art and are within the spirit of the invention. As one variation, the fuse wire 51 might be replaced with a fuse ribbon of proper design, for example as described in U.S. patent application Ser. No. 917,822 filed June 21, 1978 in the name of J. F. Howard and assigned to the same assignee as the present application.

The embodiments of the invention in which an exclusive property or privilege is claimed are defined as follows:

1. A fusible device comprising, a cylindrical casing primarily of electrical insulating material and having a first end and a second end, a first end closure closing said first end of said casing, an expulsion tube primarily of electrical insulating material within said casing extending substantially coaxially therewith mounted at one end adjacent to said first end closure and projecting beyond said second end of said casing and terminating with an open end, a second end closure at said second end of said casing in sealing relationship with said casing and said expulsion tube, a fusible link within said expulsion tube having a fusible portion and a flexible cable extending to and projecting from said open end.

a connector terminal at said second end of said casing, and a fuse element within said casing connected at one end to said connector terminal and at the other end adjacent said first end closure to said fusible link.

2. A fusible device comprising, a cylindrical casing primarily of insulating material having a first end and a second end, a first end closure closing said first end of said casing, an expulsion tube primarily of insulating material having a first and a second end and extending substantially coaxially within said casing and spaced therefrom, expulsion tube mounting means within said casing mounted to said first end closure for mounting said first end of said expulsion tube, the second end of said expulsion tube projecting beyond said second end of said casing, a second end closure of annular configuration at said second end of said casing in sealing relationship with said casing and said expulsion tube to close said second end of said casing, a fusible link within said expulsion tube having a relatively low current fusible portion adjacent said first end of said expulsion tube and a flexible cable extending along said expulsion tube and projecting from said second end, a connector terminal at said second end of said casing, and a current limiting fuse element within said casing, extending helically around said expulsion tube, connected at one end to said connector terminal and at the other end making an electrically conductive connection to said fusible link, the enclosed volume between said casing and said expulsion fuse having an arc quenching filling material to assist in controlling the arc established upon fusing of the fuse element.

3. A fusible device as defined in claim 2 in which said expulsion tube mounting means is a metallic end member having a base and a projecting cylindrical portion, said base being attached to said first end closure and said cylindrical portion receiving said first end of said expulsion tube.

4. A fusible device as defined in claim 3 in which said cylindrical portion has an internal thread and said first end of said expulsion tube has a mating external thread for threaded engagement of said expulsion tube with said expulsion tube mounting means.

5. A fusible device as defined in claim 2 in which said first and second end closures are of insulating material.

6. A fusible device as defined in claim 2 in which said filling material is silicon dioxide sand.

7. A fusible device as defined in claim 2 in which said second end closure includes an O-ring seal making sealing engagement with said expulsion tube.

8. A fusible device as defined in any one of claim 1, 2 or 4 further including fuse mounting means on said connector terminal whereby said fusible device may be mounted and supported intermediate the ends of said device.

9. A fusible device as defined in any one of claims 1, 2 or 4 in which said fuse element is a fuse wire spaced from said expulsion tube and is intermediate said tube and said casing.

10. A fusible device having a high current limiting section and a relatively low current expulsion section, said low current expulsion section comprising an expulsion tube having a first end and a second end, said second end being open, and a flexible fuse link within said expulsion tube having a relatively low current fusible portion adjacent said first end and secured at said first end, and a flexible cable extending along said expulsion tube and projecting from said second end, said high current limiting section comprising a cylindrical insulating casing having a first end and a second end, said expulsion tube having a portion within said casing and spaced therefrom, extending substantially coaxially with said casing, an end closure closing said first end of said casing, expulsion tube mounting means within said casing and mounted on said end closure on said first end of said casing, said first end of said expulsion tube being mounted by said expulsion tube mounting means, an annular end closure at said second end of said casing in sealed relation to said casing and said expulsion tube to close said second end of said casing, said expulsion tube projecting beyond said annular end closure, a connector terminal at said second end of said casing, and a current limiting fuse element within said casing extending helically around said expulsion tube, connected at one end thereof to said connector terminal and at the other end thereof at said first end of said expulsion tube to said fusible link, the enclosed volume between said casing and said expulsion tube having a pulverulent filling material to assist in controlling the arc established during fusing of the fuse element.

* * * * *